US006561095B1

(12) United States Patent
Michalik et al.

(10) Patent No.: US 6,561,095 B1
(45) Date of Patent: May 13, 2003

(54) DEVICE FOR CLEANING A ROLLER

(75) Inventors: Horst Bernhard Michalik, Höchberg (DE); Manfred Wolfgang Hartmann, Elfershausen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/868,616

(22) PCT Filed: Dec. 24, 1999

(86) PCT No.: PCT/DE99/04063

§ 371 (c)(1),
(2), (4) Date: Jun. 25, 2001

(87) PCT Pub. No.: WO00/40414

PCT Pub. Date: Jul. 13, 2000

(30) Foreign Application Priority Data

Dec. 31, 1998 (DE) ..... 198 60 859

(51) Int. Cl.[7] ..... B41L 41/00
(52) U.S. Cl. ..... 101/425; 101/424
(58) Field of Search ..... 101/425, 424, 101/423; 15/256, 256.51, 256.52, 256.53; 134/151, 159

(56) References Cited

U.S. PATENT DOCUMENTS

| | | | | |
|---|---|---|---|---|
| 3,999,239 A | | 12/1976 | Misuna | 15/256.52 |
| 4,236,450 A | | 12/1980 | Bonomi | 101/425 |
| 4,826,539 A | | 5/1989 | Harpold | 134/10 |
| 4,905,596 A | | 3/1990 | Kobler | 101/126 |
| 4,972,780 A | * | 11/1990 | Gasparrini et al. | 101/217 |
| 5,148,746 A | | 9/1992 | Fuller | 101/142 |
| 5,575,211 A | * | 11/1996 | Harrison | 101/423 |
| 5,575,327 A | * | 11/1996 | Kato | 15/256.51 |
| 5,732,631 A | | 3/1998 | Walther | 101/424 |
| 5,943,956 A | * | 8/1999 | Marquez et al. | 101/423 |

FOREIGN PATENT DOCUMENTS

| | | |
|---|---|---|
| DE | 27 39 556 A1 | 3/1978 |
| DE | 37 35 302 C2 | 10/1991 |
| DE | 295 12 758 U1 | 11/1995 |
| EP | 0747 217 A2 | 12/1996 |

* cited by examiner

*Primary Examiner*—Anthony H. Nguyen
(74) *Attorney, Agent, or Firm*—Jones Tullar & Cooper, PC

(57) ABSTRACT

A device for cleaning a roller in a rotary printing press uses a plurality of rotating brushes. Spray nozzles are arranged centrally in each of these rotating brushes. The brushes are supported on a carriage that can be moved along the length of the roller which is to be cleaned.

24 Claims, 3 Drawing Sheets

DEVICE FOR CLEANING A ROLLER

FIELD OF THE INVENTION

The present invention relates to a device for cleaning a roller of a rotary printing press. At least one rotating cleaning element, whose axis of rotation is not parallel with the axis of rotation of the roller to be cleaned, is arranged adjacent that roller. Several cleaning elements, having opposite directions of rotation, can be used.

DESCRIPTION OF THE PRIOR ART

A device for cleaning rollers is known from EP 0 693 378 B1. A brush roller is guided along the roller to be cleaned, and a cleaning fluid is simultaneously introduced into the inlet gap between the two rollers. This prior art device contains a reservoir for cleaning fluid and a catch basin for dirt particles to be removed.

A printing plate cleaning device is known from U.S. Pat. No. 5,148,746. A rotatable brush, in the shape of a truncated cone, and which can be moistened on the exterior, can be placed obliquely, i.e. at an acute angle in respect to the radial direction, against the plate cylinder, so that only a portion of the brush is in contact with the plate surface. In addition, the edge zone of the brush is beveled in such a way that a section of the brush in the shape of an arc of a circle can be brought into contact with the plate surface.

EP 0 747 217 A2 discloses a cleaning device for cylinders of printing presses. Two rotating brushes, which are offset in respect to each other in the circumferential direction of the cylinder, are provided.

SUMMARY OF THE INVENTION

The object of the present invention is based on providing a device for cleaning a roller of a rotary printing press.

In accordance with the present invention, this object is attained by using several rotating cleaning elements to clean the roller. These rotating cleaning elements each have an axis of rotation that is not parallel with the axis of rotation of the roller to be cleaned. The several rotating cleaning elements may have opposite directions of rotation with respect to each other.

The advantages which can be obtained by the present invention rest, in particular, in that an evenly cleaned surface of the rollers or cylinders is obtained. Accumulations of ink or dirt are mechanically removed, except for a thin layer, during either running or standstill of the press. In case of intense soiling, it is possible to apply a cleaning fluid, and the rollers can also be additionally cleaned by the rotating brushes.

Furthermore, it is advantageous, in connection with the present invention, that it is possible to apply an ink separating agent shortly prior to the start of printing. The creation of paper waste, which must be disposed of as special waste, is prevented by use of the cleaning device in accordance with the present invention. Moreover, by removing or preventing the accumulation of dirt on the roller, which roller may be, for example a paper guide roller, the creation of creases in the paper web is prevented.

Finally, it is also advantageous that a paper guide roller, which cannot be driven, can be brought to the required circumferential speed by the auxiliary drive mechanism, for example prior to drawing in a paper web.

BRIEF DESCRIPTION OF THE DRAWINGS

Preferred embodiments of the present invention are represented in the drawings and will be described in greater detail in what follows. Shown are in.

DESCRIPTION OF THE PREFERRED EMBODIMENT

Figure 1:
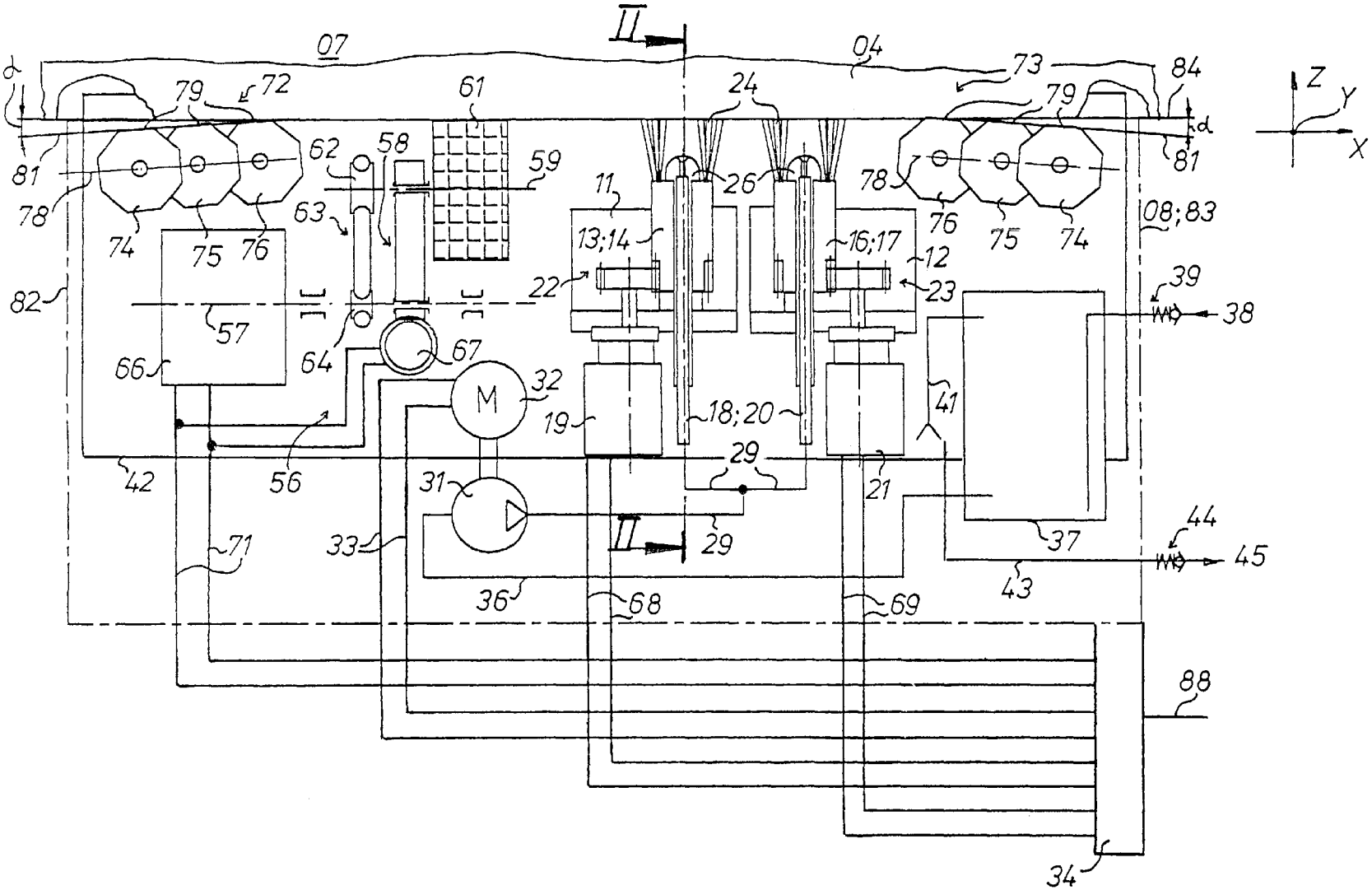
FIG. 1, a top plan view on the device for cleaning a roller in accordance with the present invention in a schematic representation, without the housing and carriage guide, FIG. 2, a section II—II through the device in accordance with FIG. 1, but showing a paper web and carriage guide, as well as the section rotated by 90°, and in FIG. 3, a top view of a paper guide roller with a device arranged thereon in the position of rest in a schematic representation with a paper web guide differing from FIG. 2.
Figure 3:
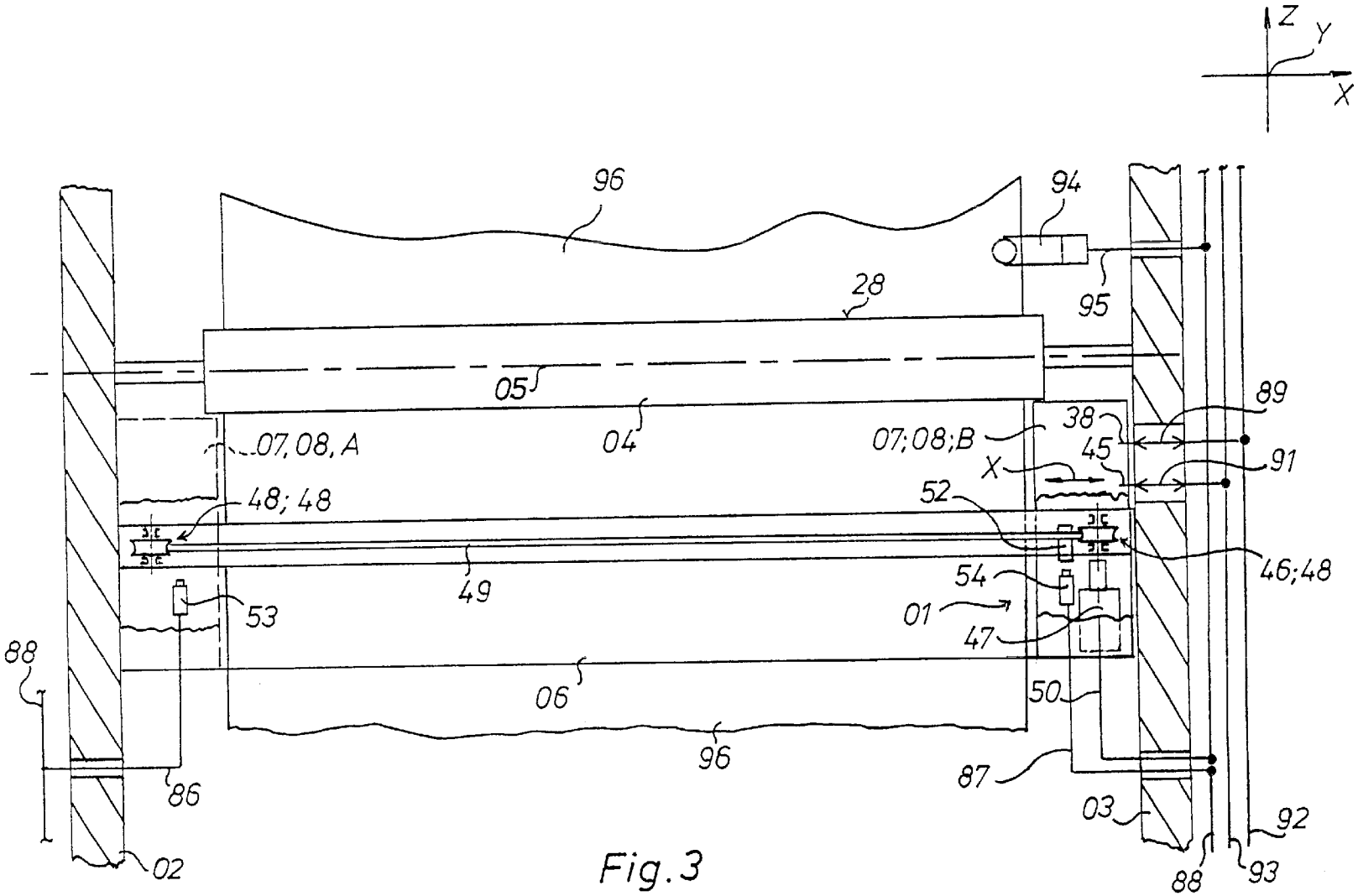

A device 01 for cleaning a roller 04, or a cylinder or the like, is arranged in the immediate vicinity of a guide roller 04 that is seated between two lateral frames 02, 03, as seen in FIG. 3. Roller 04 may be, for example, a paper guide roller 04, having an axis of rotation 05. The roller cleaning device 01 consists of a carriage guide 06, which is arranged axis-parallel with the paper guide roller 04 and is fixed in place in the lateral frames. Carriage guide 06 receives a carriage 07, which is movable in the x-direction of a right-angled spatial coordinate system. The carriage 07 supports an approximately box-shaped housing 08, which has an opening 09 on its side facing the paper guide roller 04, all as seen in FIG. 1.

Figure 2:
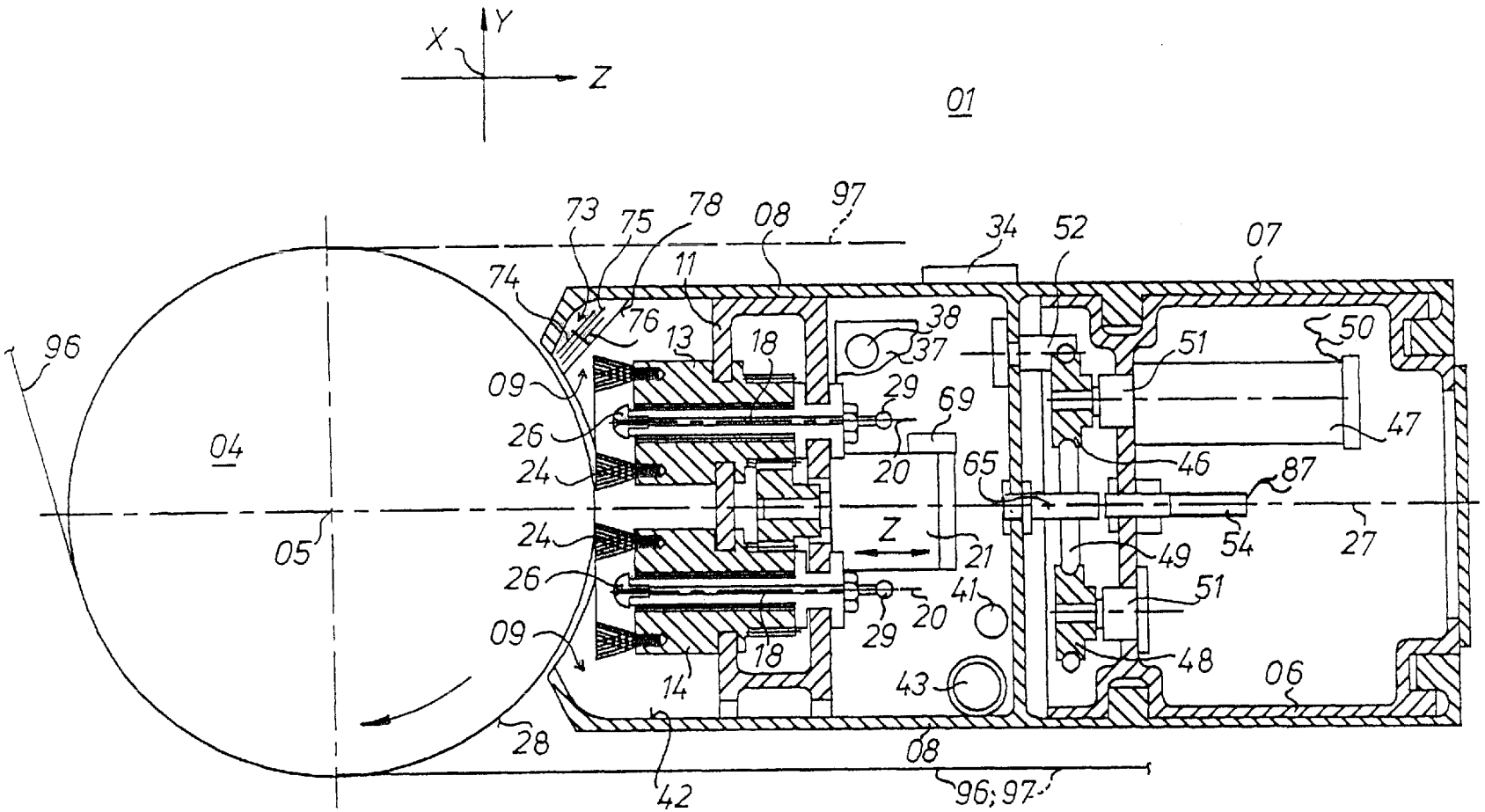

Cleaning elements, for example two brush holders 11, 12, are placed next to each other, and are displaceable back and forth in the radial direction Z of the paper guide roller 04, as seen in FIG. 2. These brush holders 11, 12, which can be fixed in place against the wall of the housing 08, are arranged inside the housing 08. Each one of the brush holders 11, 12 takes respectively two brushes 13, 14, or 16, 17, which are arranged above each other. Each brush 13, 14, 16, 17 is respectively rotatably seated on a hollow shaft 18 arranged on the brush holder 11, 12. Two brushes 13, 14, or 16, 17, located above each other, are driven by a motor 19, 21 flanged on the brush holder 11, 12, for example an electric motor, via a gear 22, 23.

Each brush 13, 14, 16, 17 has a rotatable brush head 24 extending in the direction toward the paper guide roller 04. The brush head 24 is embodied as a front brush with a circle- or ring-shaped bristle trim. It is also possible to employ small plastic sponges in place of bristles. An axis of rotation 20 of each brush 13, 14, 16, 17 extends axis-parallel with the x-axis of the previously mentioned spatial coordinate system. On its end close to the roller 04, each hollow shaft 18 has a spray nozzle 26. A nozzle opening is arranged centered in each brush head 24.

The brush heads 24 always turn in opposite directions of rotation. This is achieved because the motors 19, or 21, which work together with the pairs of brushes 13, 14, or 16, 17, rotate by turning toward each other.

Only the portions of each brush head 24, which are in the immediate vicinity of an axis 27 extending in the z-direction, as seen in FIG. 2, are in contact with the surface 28 of the paper guide roller 04. The portions of each brush head 24, which are further removed from the horizontal axis 27, are not in contact with the surface 28 of the paper guide roller 04.

An axis of rotation 20 of the cleaning elements or brushes 13, 14, 16, 17 forms an opening angle of −45° to +45° with a radial line extending through the contact zone between the cleaning elements 13, 14, 16, 17 and the roller 04.

The respective hollow shaft 18 of each brush 13, 14, 16, 17 is connected by a pressure line 29 with a pump unit 31, whose motor 32, which may be, for example an electric motor, is connected by electrical lines 33 with an electrical receptacle 34 fastened on the housing 08. The pump unit 31, in turn, is connected via a suction line 36 with a reservoir 37 for fluids, for example a cleaning fluid or a liquid separating agent.

The reservoir 37 has a filling connection 38 for fluids in the vicinity of the housing 08, as well as an associated check valve 39 and an overflow line 41.

On its lower side, the housing 08 is embodied as a catch basin 42 for fluids and dirt particles. Catch basin 42 is connected, via a suction line 43, with a disposal connector 45 in the vicinity of the housing, as well as with an associated check valve 44.

The motors 19, 21 are each connected with the receptacle 34 by electrical lines 68, 69.

A carriage drive belt 49 is arranged within the carriage guide 06, as seen in FIGS., 2 and 3 via a belt drive pulley 46, which pulley 46 is driven by a motor 47, for example an electric motor. Carriage drive belt 49 is further supported by, for example, three further belt reversing pulleys 48, and is guided between the lateral frames 02, 03. Each of the carriage drive belt pulleys 46, 48 is rotatably seated on a journal 51 fixed in place on the carriage. The carriage drive belt 49 is releasable connected with the carriage 07 by means of a coupling 52, for example a bolt with a clamping device. The carriage drive belt drive pulley motor 47 is connected via an electrical line 50 with the central electrical line 88, as shown in FIG. 3.

The carriage 07 has a contact piece 65, for example, a bolt as shown in FIG. 2, which is fixed on the carriage, and which, during the back- and-forth movement of the carriage 07 into a left or a right end position A or B shown in FIG. 3, is in contact with an end position sensor 53 or 54 fixed on the carriage guide 06, as seen in FIGS. 2 and 3. The end position sensors 53, 54 are each connected, via electrical lines 86, 87, with the central electrical line 88 to the press control console. The same applies for the electrical receptacle 34. The motor 47 of the carriage drive belt drive pulley mechanism can be switched off by the end position sensors 53 or 54.

If a paper guide roller 04 is without its own drive mechanism, or without external drive, as provided by a paper web, the carriage 07 can be provided with an auxiliary paper guide roller drive mechanism, generally at 56.

This auxiliary paper guide roller drive mechanism 56 consists of a two-armed lever 58, for example, which is pivotably arranged, at a first end, on a shaft 57 seated fixed in place on the carriage, and which lever 58 supports, on its second end close to the paper guide roller 04, a rotatably seated shaft 59 with a drive pulley 61, for example coated with rubber, and a belt pulley 62, arranged fixed against relative rotation in respect to the shaft 59, of a belt drive 63. A drive pulley 64 of the belt drive 63 is connected, fixed against relative rotation, with the support shaft 57, which drive pulley 64 is driven by a motor 66, for example an electric motor, all as may be seen in FIG. 1.

The second end of the lever 58 can be pivoted about shaft 57 and against the force of a spring, not specifically represented, by switching on a lift magnet 67, so that the drive pulley 61 is placed against the paper guide roller 04.

The motor 66, as well as the lift magnet 67, are each connected with the receptacle 34 by common electrical lines 71, so that when the motor 66 is switched on, the lever 58 with the drive pulley 61 located on it is also simultaneously pivoted away. With the appropriate activation of the motor 66, as well as the lift magnet 67, by means of an electrical signal issued at the start of the draw-in process, this auxiliary drive 56 can also be used to accelerate a non-driven paper guide roller 04 to the required circumferential speed prior to the draw-in of the paper web. It is a prerequisite for this that the carriage 07 is located between the end positions A, B.

The acceleration of the paper guide roller 04 by means of the paper web to be drawn in, and therefore the premature soiling of the paper guide roller, is avoided by this.

The carriage 07 furthermore has one or two doctor blade devices 72, 73, as shown in FIGS. 1 and 2. Each one of the doctor blade devices 72, 73 is arranged at the left, or right, end of the x-axis of the carriage 07 in an area close to the paper guide roller. Each one of the doctor blade devices 72, 73 consists of one or more doctor blades, for example three round, or preferably polygonal, for example octagonal, doctor blades 74, 75, 76 each made of a thin material, for example of an abrasion-resistant plastic material, for example polyamide, approximately 1 mm thick, or of brass. By use of a holding device 78, fixed in place on the carriage, the doctor blade disks 74 to 76 are arranged overlapping each other and rotatable around a center axis in such a way, that one of their eight work edges 79 always rests on an imaginary straight operating line 81.

The straight operating line 81 extends at an acute angle $\alpha$ of, for example 3° to 8°, in respect to an imaginary line 84, extending on the surface 28 of the paper guide roller 04 parallel with the axis of rotation of roller 04, as seen in FIG. 1, so that the distance of the work edges 79 of the doctor blade disks 74 to 76 from the line 84 respectively increases in the direction toward the left and right lateral edges or sides 82, 83 of the carriage 07. The result of this is that during a cleaning move of the carriage 07 from the right end position B in to the left end position A, the respectively wedge—like acting doctor blade disks 74 to 76 mechanically reduce the deposits of ink and paper fibers, which for example have been irregularly built up, to a minimum thickness . An overstress of the work edges 79 is avoided by the wedge-shaped or angled arrangement of the doctor blade disks. In this case, a minimal distance of approximately 0.02 mm remains between the surface 28 of the paper guide roller 04 and the doctor blade disk 76 located closest to it.

If the two spaced doctor blade devices 72, 73 are arranged as seen in FIG. 1, the work edges 79 of the two doctor blade devices 72, 73 form an opening angle of 164° to 174°, for example.

The filling connection 38 for the fluid reservoir 37, as well as the disposal connector 45 for the catch basin 42 of the carriage 07 are each respectively connected by intermediate lines 89, 91 with a central supply line 92, or with a central disposal line 93. This can take place, for example, in that the intermediate lines 89, 91 between the carriage 07 and the supply line 92, or the disposal line 93, are designed as trailing lines. It is furthermore also possible to fill, or empty, the fluid reservoir 37 and the catch basin 42 of the carriage 07 via the intermediate lines 89, 91 while the carriage 07 is parked in the right end position B shown in FIG. 3.

Viewed in the carriage 07 operating direction, i.e. in the axial direction of the roller 04, the respective doctor blade device 72, 73 is arranged ahead of or before, in the direction of carriage travel, the brushes 13, 14, 16, 17. In this way, two differently operating cleaning elements 13, 14; 16, 17; 72, 73 act on the roller 04, and preferably act simultaneously, i.e. the doctor blade device 72, 73 is used for pre-cleaning.

The cleaning device of the present invention can be operated as follows: a sensor 94, which is connected via an electrical line 95 with the central electrical line 88, determines whether a paper web 96, as shown in FIGS. 2 and 3 has been provided for driving the paper guide roller 04 to be cleaned, or for driving another similar roller to be cleaned, for example a draw-in roller. It is, of course, also possible for a paper web 97, as shown in dashed lines in FIG. 2, to be wrapped around a paper guide roller 04 by 180°. If no paper web 96, 97 is provided, the lift magnet 67, together with the motor 66, is switched on by operation of the sensor 94, so that the drive pulley 61 turns. The motor 47 is acted upon at the same time, so the carriage 07 moves out of the end position B in the direction toward the end position A.

Depending on a preselected mode of operation of the cleaning device 01 the surface 28 of the paper guide roller 04 can either be wiped off, or can be both wiped off and sprayed with cleaning fluid or, for intense treatment, can later be processed by the rotating brushes 13, 14, 16, 17. In the last case, i.e. with intense brush cleaning, it is logical to retract the brush holder 11, 12 in the z-direction after reaching the end position A. It is prevented by this retraction that the fluid film applied to the surface 28 of the paper guide roller 04 is subsequently destroyed.

The movement, for example the retraction of the brush holders 11, 12 in the z axis direction, as seen in FIG. 2, can take place by use of a known, remotely controllable actuator, not specifically represented, for example a servo motor fixed in place on the carriage, and provided with a threaded spindle seated fixed in place on the carriage.

It is recommended to clean the paper guide or draw-in rollers at the end of a production run and to apply a liquid separating agent, for example a mixture of silicon and water, to them prior to the next start of production.

The reservoir 37 can be selectively filled, using the filling connection 38, with cleaning fluid or with liquid separating agent. The amount of fluid taken up by the reservoir 37 is sufficient for spraying a roller surface.

During filling of the reservoir, an excess of cleaning fluid, for example 20% more cleaning fluid, is supplied to the reservoir 37, which excess cleaning fluid then leaves the reservoir 37 through the overflow line 41 and is thus used for rinsing the catch basin 42.

While a preferred embodiment of a device for cleaning a roller in accordance with the present invention has been set forth fully and completely hereinabove, it will be apparent to one of skill in the art that a number of changes in, for example, the particular type of printing press, the overall size of the device, and the like could be made without departing from the true spirit and scope of the subject invention which is accordingly to be limited only be the following claims.

What is claimed is:

1. A device adapted for cleaning a roller of a rotary printing press comprising:

a plurality of rotatable cleaning elements, each having an axis of rotation arranged not parallel with an axis of rotation of the roller, said plurality of rotatable cleaning elements being arranged next to each other along the axis of rotation of the roller, at least two of said plurality of rotatable cleaning elements having opposite directions of rotation;

a carriage supporting said plurality of rotatable cleaning elements, said carriage being displaceable along the axis of rotation of the roller;

a drive motor on said carriage for rotating said plurality of cleaning elements;

an actuator on said carriage for moving said plurality of rotatable cleaning elements in a radial direction with respect to the roller to be cleaned; and a doctor blade device, said doctor blade device being located before, in a direction of travel of said device along the roller, said plurality of rotatable cleaning elements.

2. The device of claim 1 wherein said axis of rotation of said cleaning elements forms an angle of −45° to +45° with a radial line extending through a contact zone of said cleaning elements and the roller.

3. The device of claim 1 further including at least one opening for cleaning fluid in each of said plurality of rotatable cleaning elements.

4. The device of claim 3 wherein said opening is arranged inside each of said plurality of rotatable cleaning elements.

5. The device of claim 1 further including means to displace said device in the axial direction of the roller.

6. The device of claim 1 wherein each said cleaning element is a brush.

7. The device of claim 6 wherein each said brush includes bristles.

8. The device of claim 6 wherein said brushes and said doctor blade device are operable at the same time.

9. The device of claim 1 wherein each said cleaning element is a front brush.

10. The device of claim 9 further including a doctor blade device, said doctor blade device being located before, in a direction of travel of said device along the roller, said plurality of front brushes.

11. The device of claim 10 wherein said front brushes and said doctor blade device are operable at the same time.

12. The device of claim 1 wherein the roller is a guide roller.

13. A device adapted for cleaning a roller of a rotary printing press comprising:

a plurality of rotatable cleaning elements, each having an axis of rotation arranged not parallel with an axis of rotation of the roller, said plurality of rotatable cleaning elements being arranged next to each other with respect to the axis of rotation of the roller and behind each other in a circumferential direction of the roller;

a carriage supporting said plurality of rotatable cleaning elements, said carriage being displaceable along the axis of rotation of the roller;

a drive motor on said carriage for rotating said plurality of cleaning elements;

an actuator on said carriage for moving said plurality of rotatable cleaning elements in a radial direction with respect to the roller to be cleaned; and a doctor blade device, said doctor blade device being located before, in a direction of travel of said device along the roller, said plurality of rotatable cleaning elements.

14. The device of claim 13 wherein said axis of rotation of said cleaning elements forms an angle of −45° to +45° with a radial line extending through a contact zone of said cleaning elements and the roller.

15. The device of claim 13 further including at least one opening for cleaning fluid in each of said plurality of rotatable cleaning elements.

16. The device of claim 15 wherein said opening is arranged inside each of said plurality of rotatable cleaning elements.

17. The device of claim 13 further including means to displace said device in the axial direction of the roller.

18. The device of claim 13 wherein each said cleaning element is a brush.

19. The device of claim 18 wherein each said brush includes bristles.

20. The device of claim 18 wherein said brushes and said doctor blade device are operable at the same time.

21. The device of claim 13 wherein each said cleaning element is a front brush.

22. The device of claim 21 further including a doctor blade device, said doctor blade device being located before, in a direction of travel of said device along the roller, said plurality of front brushes.

23. The device of claim 22 wherein said front brushes and said doctor blade device are operable at the same time.

24. The device of claim 13 wherein the roller is a guide roller.

* * * * *